US006035454A

United States Patent [19]

Birchall

[11] Patent Number: 6,035,454

[45] Date of Patent: Mar. 14, 2000

[54] TOILET SEAT AND LID CLOSING ASSEMBLY

[76] Inventor: Thomas D. Birchall, 2161 N. Daubenberger Rd., Turlock, Calif. 95382-2984

[21] Appl. No.: 09/239,012

[22] Filed: Jan. 28, 1999

Related U.S. Application Data

[60] Provisional application No. 60/072,942, Jan. 29, 1998.

[51] Int. Cl.[7] ..... A47K 13/10

[52] U.S. Cl. ..... 4/246.2; 4/236

[58] Field of Search ..... 4/236, 240, 241, 4/246.2, 250; 188/306, 307

[56] References Cited

U.S. PATENT DOCUMENTS

| | | | |
|---|---|---|---|
| 4,426,743 | 1/1984 | Seabrooke | 4/241 X |
| 5,193,230 | 3/1993 | Guerty | 4/246.2 |
| 5,768,718 | 6/1998 | Sorimachi | 4/246.2 |

*Primary Examiner*—Charles E. Phillips
*Attorney, Agent, or Firm*—Townsend and Townsend and Crew LLP

[57] ABSTRACT

A toilet seat or lid closing device includes a housing having an inner wall. A shaft assembly includes a shaft, movable between first and second rotary orientations. A first part of the shaft assembly is housed within the housing, and includes an outwardly extending blade, having first and second faces, extending outwardly to an outer edge. A portion of the inner wall of the housing and the outer edge of the blade define a variable-thickness gap therebetween as the shaft assembly moves between the first and second rotary orientations. Several openings extend through the blade, the openings covered on one side of the blade with a flexible material to create check valves. The check valves permit relatively free fluid flow through the opening, thus bypassing the blade, when the seat or lid is lifted but at least substantially prevents fluid flow through the openings when the seat or lid is lowered.

10 Claims, 4 Drawing Sheets

TOILET SEAT AND LID CLOSING ASSEMBLY

CROSS-REFERENCE TO RELATED APPLICATIONS

This application claims the benefit of and is a continuation-in-part of Provisional Application No. 60/072,942, filed Jan. 29, 1998 and entitled "Automatic Toilet Seat and Lid Closing Device".

BACKGROUND OF THE INVENTION

One problem which never seems to go away is the toilet lid or both the toilet lid and seat are frequently left up. This often results in considerable annoyance and unpleasant dialog between users of the bathroom. More dire consequences, including dropping of objects into the uncovered toilet, can result when the lid has been left up.

SUMMARY OF THE INVENTION

The present invention provides a simple solution for insuring that a toilet bowl covering member, preferably both the lid and the seat, is automatically returned to is lowered positions after use.

A toilet bowl covering member closing device includes a housing having an inner wall. A shaft assembly includes a shaft, a first part of which is housed within the housing. The shaft assembly is movable between first and second rotary orientations. The first part of the shaft assembly includes an outwardly extending member having first and second faces extending outwardly from the shaft to an outer edge. A portion of the inner wall of the housing and the outer edge of the outwardly extending member define a variable-thickness gap therebetween as the shaft assembly moves between the first and second rotary orientations. A bypass element includes a bypass flow path extending between first and second positions within the housing interior. The bypass element permits relatively free fluid flow along the bypass flow path when the shaft is moved in a second direction from the second rotary orientation towards the first rotary orientation. However, fluid flow along the bypass flow path is at least substantially prevented when the shaft assembly moves in a first direction from the first rotary orientation towards the second rotary orientation.

In a preferred embodiment, the housing interior is filled with a damping liquid, and the bypass element includes bypass flow paths defined by openings passing through the outwardly extending member of the shaft assembly with a check valve for each opening. A spring can couple the shaft to the housing to rotate the shaft in the first direction. If desired, a trigger, catch or other structure for temporarily preventing the shaft assembly from moving from the first rotary orientation may be used.

First and second of the closing devices can be used with the shaft of the first closing device secured to a lid hinge arm and the shaft of the second closing device secured to a seat hinge arm. The first closing device preferably includes the spring which biases the shaft to rotate in the first direction and the trigger or other structure which normally prevents the shaft assembly from moving from the first rotary orientation until the toilet is flushed.

A primary advantage of the invention is its simplicity. It is relatively simple in construction and can be made to be unobtrusive. The invention is easy to use and can be, if desired, easily made to be overridden when it is desired to move the seat and/or lid without flushing the toilet.

Other features and advantages of the invention will appear from the following description in which the preferred embodiment has been set forth in detail in conjunction with the accompanying drawings.

DESCRIPTION OF THE PREFERRED EMBODIMENT

Figure 1:
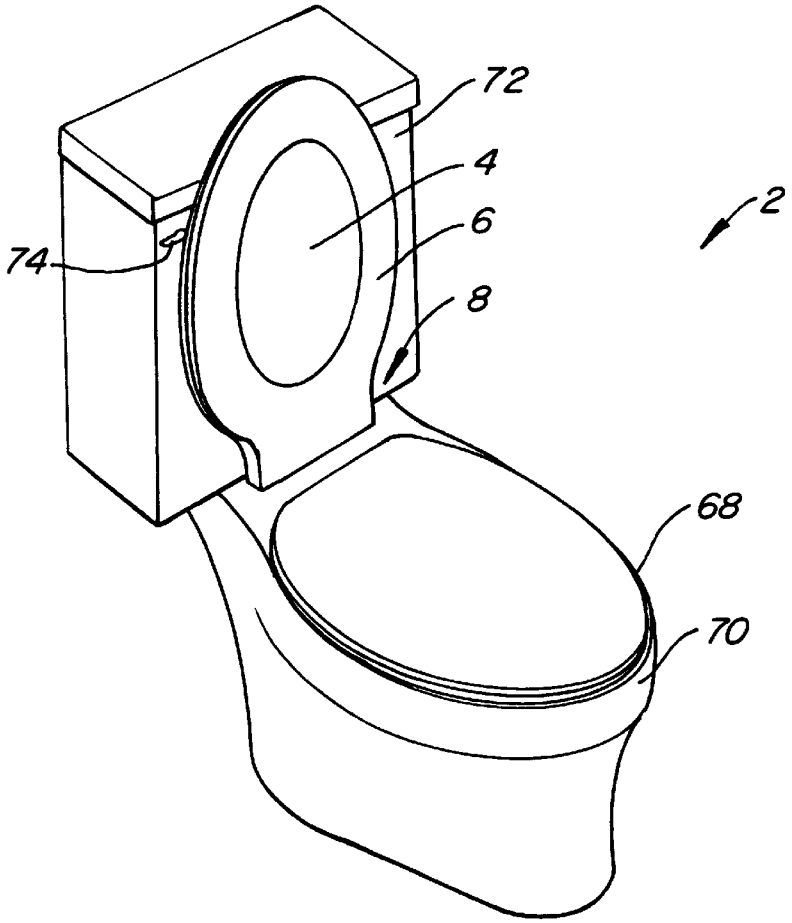
FIG. 1 is an overall view of a toilet incorporating a toilet seat and lid closing assembly made according to the invention.

FIG. 1 illustrates a conventional toilet 2 to which toilet bowl covering members, specifically a lid 4 and a seat 6, are mounted through the use of an automatic toilet seat and lid closing assembly 8. Assembly 8 includes axially-aligned lid-coupled and seat-coupled closing devices 10, 12, each having a shaft 14 extending therefrom; lid and seat hinge arms 16, 18 are mounted to and keyed or otherwise secured to shafts 14 of devices 10, 12. See FIG. 6. Assembly 8 also includes supplemental lid and seat hinge arms 20, 22 which are mounted to but rotate freely about shafts 14 of devices 12, 10. Arms 16, 20 and 18, 22 are secured to their respective lid 4 and seat 6.

Figure 3:
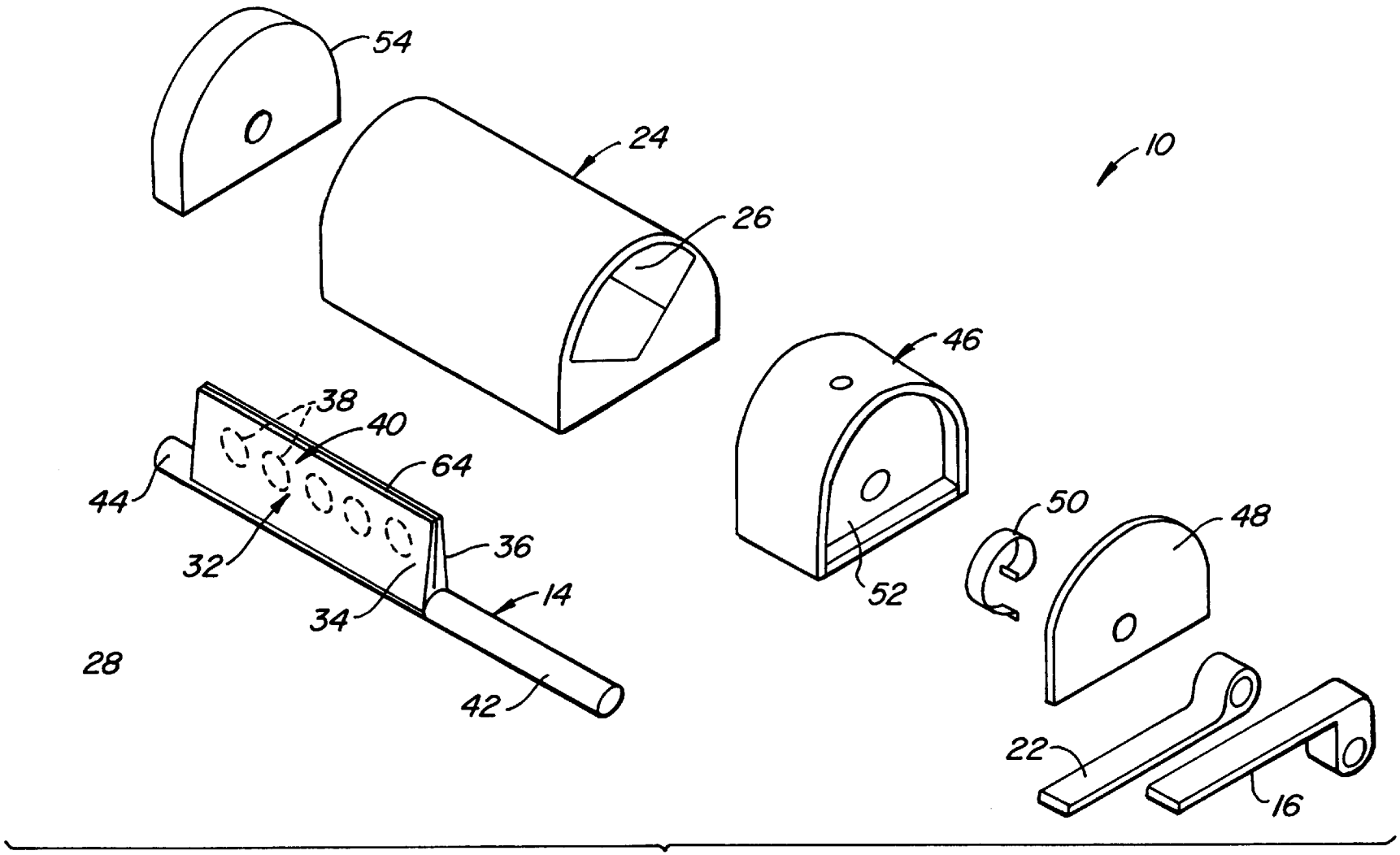
FIG. 3 is an exploded isometric view of the lid-coupled device of FIG. 2, the seat-coupled device of FIG. 2 being substantially identical with the exception of the lack of a spring and a trigger.

Lid-coupled device 10 is shown in an exploded view in FIG. 3. Device 10 is seen to include a main housing 24 having a pie-shaped interior 26 in which a shaft assembly 28 is housed. Shaft assembly 28 includes shaft 14 and an outwardly-extending blade 32. Blade 32 has a flexible side 34 and a rigid side 36 with holes 38, shown in dashed lines in FIG. 3, formed in the rigid side. This permits blade 32 to act as a piston with a set of five check valves 40 which open and close according to the direction of rotation of shaft assembly 28 as will be discussed in more detail below.

Figure 6:
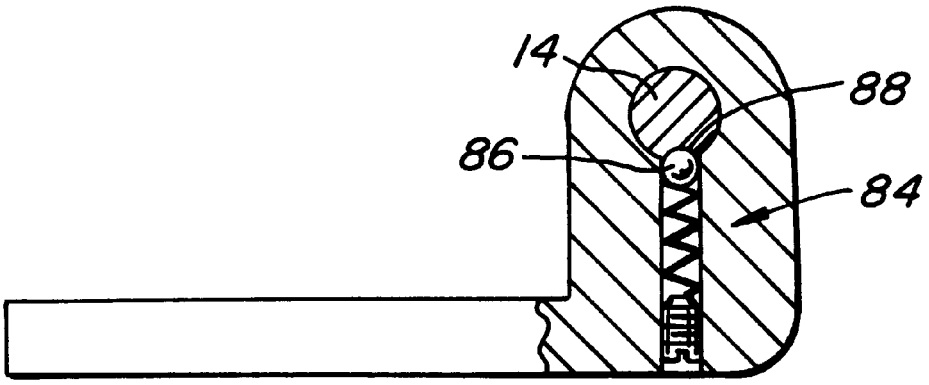
FIG. 6 is a cross-sectional view of the lid hinge arm of FIG. 3 showing how the arm is secured to the shaft using a ball detent.

Shaft 14 has a right end 42 which is longer than the left end 44. Right end 42, as seen in FIG. 5, extends through a spring housing 46 as well as a right end cap 48. Right end 42 passes through seat hinge arm 22 and lid hinge arm 16. Lid hinge arm 16 is keyed or otherwise secured to shaft 14 as shown in FIG. 6. Right end 42 of shaft 14 also passes through and is engaged by one end of a spring 50 housed within a recess 52 formed in spring housing 46. Spring 50 tends to rotate shaft assembly 28 in a counterclockwise direction (relative to FIGS. 3 and 4), thus tending to lower lid 4 and seat 6 therewith.

Left end 44 of shaft 14 passes through a left end cap 54. Left end cap 54 and spring housing 46 include O-ring seals 56, 58 which engage shaft 14. Seals 56, 58 and the engagement of left end cap 54 and spring housing 46 with main housing 24 provide a fluid-tight seal for interior 26. Pie-shaped interior 26 is filled with a suitably viscous fluid which dampens the movement of blade 32.

As thus described, spring 50 would tend to rotate shaft assembly 28, thus tending to drive lid hinge arm 16, and lid 4 therewith, downwardly from the upright, slightly backwardly tilting position of FIG. 1, past an over-center position and to a closed position adjacent to the rim of the toilet bowl. This rotational movement is normally prevented by a trigger 60, see FIG. 5, which releasably engages shaft 14 to prevent its rotation until released by the trigger. The downward movement is also resisted by the movement of blade 32 through a suitably viscous fluid in interior 26 of main housing 24.

Figure 4:
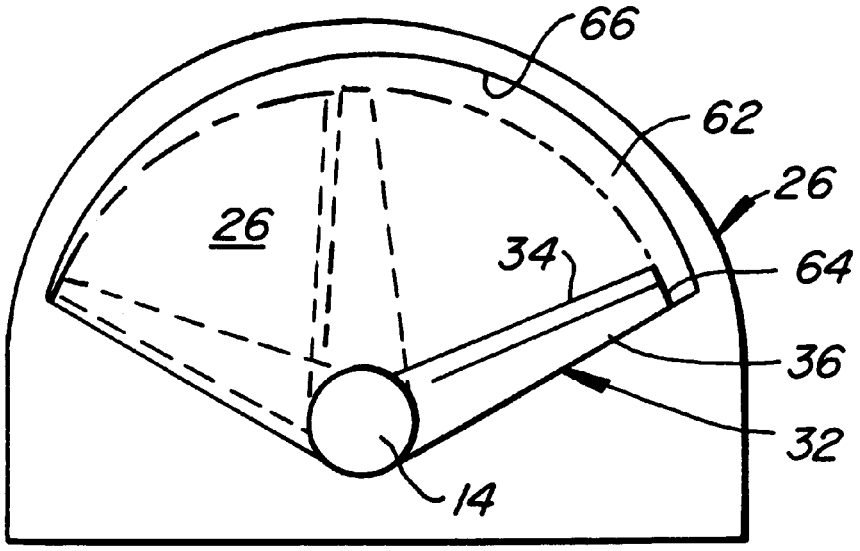
FIG. 4 is a simplified side view showing the movement of the blade within the interior of the main housing and the variable gap defined between the outer edge of the blade and the inner wall of the main housing.
Figure 5:
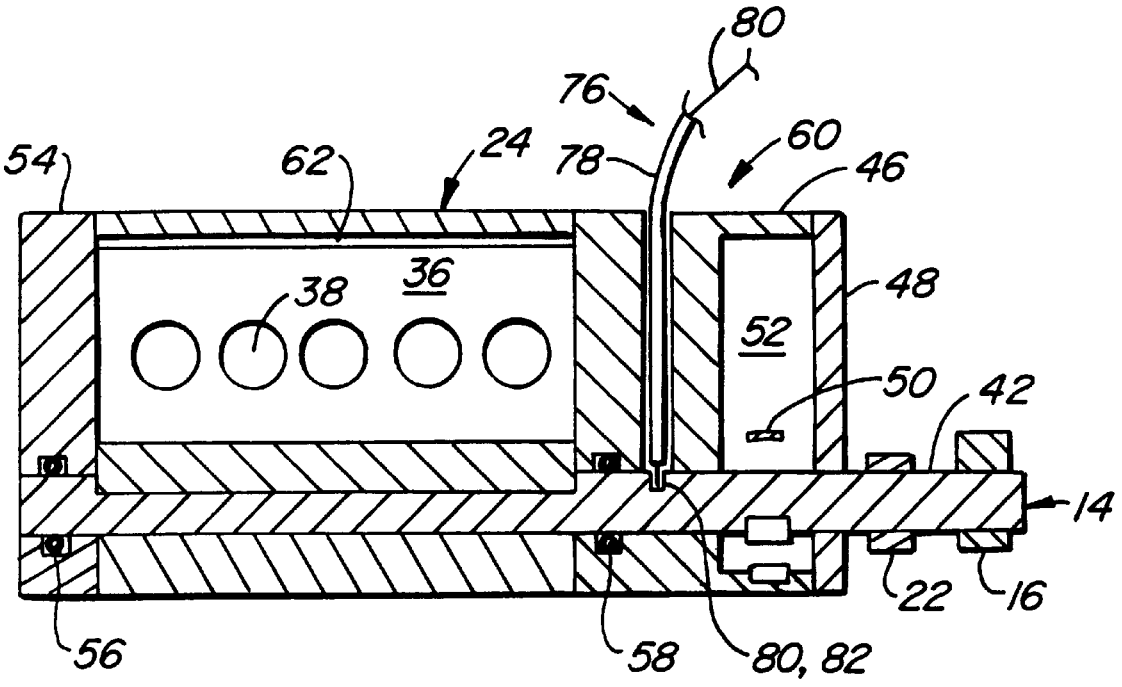
FIG. 5 is a cross-sectional view of a portion of the assembled lid-coupled device of FIG. 3 with the lid in a vertical orientation and the cutting plane line passing between the flexible and rigid sides of the blade.

As shown in FIG. 4, a variable gap 62 is defined between an outer edge 64 of blade 32 and the arcuate, smoothly-curving wall 66 defining arcuate interior 26. Thus, the resistance to the flow of the fluid around blade 32 is least during the initial movement of the blade (where the torque arm is shortest) and is greatest as lid 4 and seat 6 move toward engagement with the rim 68 of the toilet bowl 70 (where the torque arm is longest). This dampening mechanism permits the lid and seat to be lowered smoothly in a very simple manner.

Blade 32 has what is in effect a number of check valves 40 created by the flexible material-covered holes 38 formed in rigid side 36 of the blade. Thus, when moved in the clockwise direction (with reference to FIGS. 3 and 4), the fluid passes through holes 38 formed in the rigid side of the blade and causes flexible side 34 to deflect away from rigid side 36 to create a number of bypass flow paths. This permits seat 6 and lid 4 to be lifted without undue resistance from device 10.

Device 10 includes trigger 60, mentioned above, which permits lid 4 and seat 6 to move from their over-center positions of FIG. 1 toward their closed positions in response to the toilet being flushed. Actuation of trigger 60 can be accomplished in one of several ways, including a manual connection, hydraulics, or pneumatics. A preferred way is to use a device in the waterline to the toilet tank 72 which is responsive to the change in water pressure when the toilet is flushed by manipulating handle 74. This water-pressure-sensitive device is connected by a coaxial cable 76 to trigger 60. Coaxial cable 76 includes a hollow outer sheath 78 housing an axially-movable inner core 80. The distal end of inner core 80 is normally housed in a recess 82 formed in shaft 14 as shown in FIG. 5. Shaft 14 is released when inner core 80 is pulled out of recess 82 upon flushing of toilet 2. This permits spring 50 to lower lid 4 and seat 6 therewith.

FIG. 6 illustrates a feature of the invention which permits a user to override the engagement between lid hinge arm 16 and shaft 14. Rather than providing a rigid, keyed connection between the two, a spring-biased ball detent arrangement 84 can be used in the manner of an overriding clutch between lid hinge arm 16 and shaft 14. Therefore, if a user desires, lid 4 can be closed without flushing toilet 2 and without rotating shaft assembly 28 by overriding the force of engagement between the ball 86 and an appropriately-positioned recess 88 in shaft 14.

Seat-coupled closing device 12 is substantially identical to device 10 with the exceptions that device 12 need not and typically does not include spring 50 or trigger 60.

Figure 2:
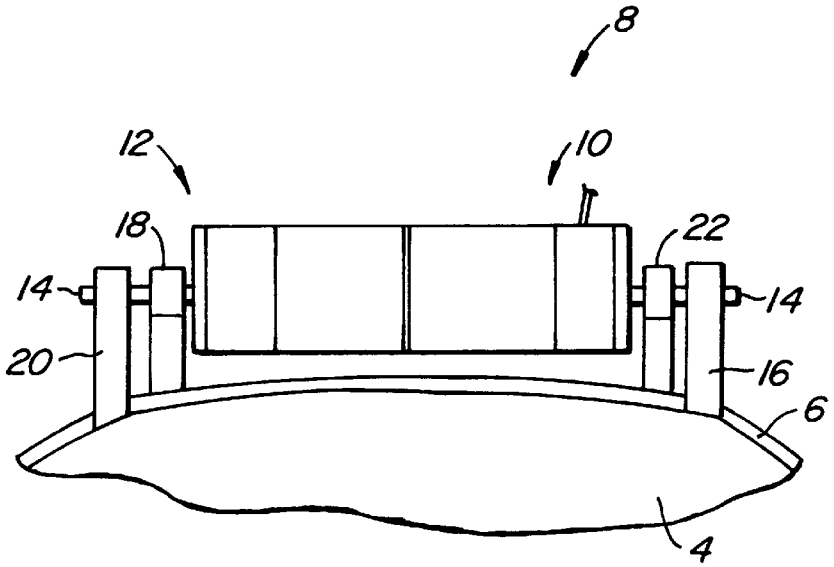
FIG. 2 is a top view of the assembly of FIG. 1 with the seat and lid moved from the first, upright position of FIG. 1 to a second, lowered or closed orientation.

In use, assuming lid 4 and seat 6 are in the orientations of FIG. 1, flushing toilet 2 causes the distal end of inner core 80 of coaxial cable 76 to be removed from recess 82 in shaft 14. This permits spring 50 to rotate shaft assembly 28 in a counterclockwise direction, thus causing lid 4 and seat 6 therewith to move from the upright orientation of FIG. 1 to the lowered, generally vertical orientation of FIG. 2. This movement is dampened by the movement of blade 32 through a fluid in interior 26 of both lid- and seat-coupled device 10, 12; the damping increases as the shaft assembly 28 rotates because variable gap 62 narrows as lid 4 and seat 6 approach rim 68, thus controlling the descent of the lid and seat. When it is desired to lift lid 4 and/or seat 6, the user lifts one or both. The damping created by blade 32 is lessened during this clockwise movement of shaft assembly 28 because flexible side 34 deflects outwardly, permitting fluid to flow through holes 38. Once in the proper upright orientation, inner core 80 once again enters recess 82, thus preventing spring 50 from rotating shaft assembly 28 of lidcoupled device 10. The slightly rearwardly angled orientation of seat 6 in the upright orientation of FIG. 1 keeps seat 6 in place until moved by a user.

The bypass flow path created by check valves 40 could be provided in different ways. For example, a flow path with a check valve along the flow path could be created through main housing 24 connecting the interior 26 of the main housing at opposite ends of inner wall 66 and thus on opposite sides of blade 32. Instead of two separate devices 10, 12, a single device could be created with a single main housing which would house separately rotatable shaft assemblies 28. While it is preferred to use lid hinge arm 20 and seat hinge arm 22 which are freely rotatable, in appropriate cases they may be eliminated or mounted to pivot structure other than shaft 14.

It may not be necessary to use a spring 50 if lid 4 and seat 6 angle slightly forwardly when in their upright positions so that they naturally tend to pivot downwardly unless restrained. Also, neither a spring 50 nor a trigger 60 need be used if, for example, the action of moving handle 74 pushes lid 4 forwardly past vertical so lid 4 and seat 6 are lowered by gravity but restrained by blades 32 passing through the liquid within interiors 26 of devices 10, 12.

Other modifications and variations can be made to the disclosed embodiment without departing from the subject of the invention as defined in the following claims.

Any and all patents, applications and printed publications are incorporated by reference.

What is claimed is:

1. A toilet bowl covering member closing device comprising:

a housing having an inner wall;

a shaft assembly, comprising a shaft with a first part housed within the housing, for movement between first and second rotary orientation, the shaft having a portion to which a toilet bowl covering member can be connected;

the inner wall and the shaft assembly defining an at least substantially sealed housing interior;

the first part of the shaft assembly comprising an outwardly extending member, having first and second faces, extending outwardly from the shaft to an outer edge of the outwardly extending member;

the inner wall having a variable-gap portion, said variable-gap portion and the outer edge defining a variable gap therebetween as the shaft assembly moves between the first and second rotary orientations; and a bypass element comprising a bypass flow path extending between first and second positions within the housing interior, said first and second positions fluidly coupled to the first and second faces, said bypass element comprising a flow restricter which:

(1) permits relatively free fluid flow along the bypass flow path when the shaft assembly moves in a second direction from the second rotary orientation to the first rotary orientation, and (2) at least substantially prevents fluid flow along the bypass flow path when the shaft assembly moves in a first direction from the first rotary orientation to the second rotary orientation.

2. The closing device according to claim 1 wherein the shaft portion is external of said housing.

3. The closing device according to claim 1 wherein the housing interior is at least substantially filled with a damping liquid.

4. The closing device according to claim 1 wherein the variable-gap portion comprises a smoothly curving surface.

5. The closing device according to claim 1 wherein the bypass flow path comprises a hole through the outwardly-extending member having openings at the first and second faces.

6. The closing device according to claim 1 wherein the bypass element comprises a check valve element movably positioned adjacent to the first position.

7. The closing device according to claim 1 further comprising a spring coupling the shaft to the housing and biasing the shaft to rotate in the first direction.

8. The closing device according to claim 7 further comprising means for preventing the shaft assembly from moving from the first rotary orientation and means for selectively permitting the spring to move the shaft assembly in the first direction from the first rotary orientation.

9. A toilet seat and lid closing assembly comprising;

first and second of the closing devices of claim 1;

the first closing device comprising:

a spring coupling the shaft to the housing and biasing the shaft to rotate in the first direction; and means for preventing the shaft assembly from moving from the first rotary orientation and means for selectively permitting the spring to move the shaft assembly in the first direction from the first rotary orientation;

a lid hinge arm secured to and rotatable with the shaft of the first closing device; and a seat hinge arm secured to and rotatable with the shaft of the second closing device.

10. The assembly according to claim 9 further comprising:

supplemental seat and lid hinge arms freely rotatably mounted to the shafts of the first and second closing devices, respectively.

* * * * *